US008694870B2

(12) United States Patent
Li

(10) Patent No.: US 8,694,870 B2
(45) Date of Patent: Apr. 8, 2014

(54) UNEQUAL ERROR PROTECTION FOR EMBEDDED CODING OF BOREHOLE IMAGES AND VARIABLE-QUALITY TELEMETRY CHANNELS

(75) Inventor: Jiang Li, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 928 days.

(21) Appl. No.: 12/830,678

(22) Filed: Jul. 6, 2010

(65) Prior Publication Data

US 2011/0005835 A1 Jan. 13, 2011

Related U.S. Application Data

(60) Provisional application No. 61/223,568, filed on Jul. 7, 2009.

(51) Int. Cl.
*H03M 13/00* (2006.01)

(52) U.S. Cl.
USPC ..... 714/776; 714/713; 714/799

(58) Field of Classification Search
USPC ..... 714/776, 713, 718, 799
See application file for complete search history.

(56) References Cited

U.S. PATENT DOCUMENTS 4,406,919 A * 9/1983 Pospischil ..... 714/713
5,329,811 A 7/1994 Schultz et al.
5,467,083 A * 11/1995 McDonald et al. ..... 340/854.6
6,626,253 B2 9/2003 Hahn et al.
7,577,528 B2 8/2009 Li et al.
2004/0035199 A1 2/2004 Meister et al.
2007/0132606 A1 6/2007 Reckmann et al.
2007/0201308 A1 8/2007 Wassermann et al.
2008/0037369 A1 2/2008 Hentati
2008/0074948 A1 3/2008 Reckmann
2010/0039287 A1 2/2010 Li

FOREIGN PATENT DOCUMENTS

EP 0610098 A1 8/1994

OTHER PUBLICATIONS

Viterbi, A.J., "Error bounds for convolutional codes and an asymptotically optimum decoding algorithm," IEEE Trans. Information Theory, vol. 13, No. 2, pp. 260-269 (Apr. 1967).
Larsen, K.J., "Short convolutional codes with maximal free distance for rates 1/2, 1/3 and 1/4," IEEE Trans. Information Theory, vol. 19, No. 3, pp. 371-372 (May 1973).
Hagenauer, J., "Rate-compatible punctured convolutional codes (RCPC codes) and their applications," IEEE Trans. Communications, vol. 36, No. 4, pp. 389-400 (Apr. 1988).

(Continued)

*Primary Examiner* — Fritz Alphonse
(74) *Attorney, Agent, or Firm* — Mossman Kumar & Tyler PC

(57) ABSTRACT

An unequal error protection scheme for borehole telemetry. The scheme, when applied to imaging applications, assigns more protection for the more significant bits and less protection for less significant bits. When applied to communication using channels of different quality, more protection is provided for channels of poor quality.

19 Claims, 6 Drawing Sheets
(1 of 6 Drawing Sheet(s) Filed in Color)

(56) References Cited

OTHER PUBLICATIONS

Castagnoli, G., et al., "Optimum cyclic redundancy-check codes with 16-bit redundancy," IEEE Trans. Communications, vol. 38, No. 1, pp. 111-114 (Jan. 1990).

Seshadri, N., et al., "List Viterbi decoding algorithms with applications," IEEE Trans. Communications, vol. 42, Nos. 2/3/4, pp. 313-323 (Feb./Mar./Apr. 1994).

Sherwood, P.G., et al., "Progressive image coding on noisy channels," Proc. Data Compression Conf., J. Storer and M. Cohn, Eds., pp. 72-81 (1997).

Li, J., et al. "Efficient compression of borehole resistivity and acoustic imaging data using wavelets," Geophysics, vol. 70, No. 6, pp. F53-F60, (Nov.-Dec. 2005).

* cited by examiner

UNEQUAL ERROR PROTECTION FOR EMBEDDED CODING OF BOREHOLE IMAGES AND VARIABLE-QUALITY TELEMETRY CHANNELS

CROSS-REFERENCES TO RELATED APPLICATIONS

This application claims priority from U.S. Provisional Patent Application Ser. No. 61/223,568 filed on Jul. 7, 2009.

BACKGROUND OF THE DISCLOSURE

1. Field of the Disclosure

The present disclosure relates to telemetry systems for communicating information from a downhole location to a surface location, and, more particularly, to a method of increasing the data rate of transmitted signals.

2. Description of the Related Art

Drilling fluid telemetry systems, generally referred to as mud pulse systems, are particularly adapted for telemetry of information from the bottom of a borehole to the surface of the earth during oil well drilling operations. The information telemetered often includes, but is not limited to, parameters of pressure, temperature, direction and deviation of the borehole. Other parameters include logging data such as resistivity of the various layers, sonic density, porosity, induction, self potential and pressure gradients. This information is important to efficiency in the drilling operations.

Measurement-while-drilling (MWD) Telemetry is required to link the downhole MWD components to the surface MWD components in real-time, and to handle most drilling related operations without breaking stride. The system to support this is quite complex, with both downhole and surface components that operate in step.

In any telemetry system there is a transmitter and a receiver. In MWD Telemetry the transmitter and receiver technologies are often different if information is being uplinked or down-linked. In up-linking, the transmitter is commonly referred to as the Mud-Pulser (or more simply the Pulser) and is an MWD tool in the BHA that can generate pressure fluctuations in the mud stream. The surface receiver system includes sensors that measure the pressure fluctuations and/or flow fluctuations, and signal processing modules that interpret these measurements.

Down-linking may be achieved by either periodically varying the flow-rate of the mud in the system or by periodically varying the rotation rate of the drillstring. In the first case, the flow rate is controlled using a bypass-actuator and controller, and the signal is received in the downhole MWD system using a sensor that is affected by either flow or pressure. In the second case, the surface rotary speed is controlled manually, and the signal is received using a sensor that is affected.

For uplink telemetry, a suitable pulser is described in U.S. Pat. No. 6,626,253 to Hahn et al., having the same assignee as the present application and the contents of which are fully incorporated herein by reference. Described in Hahn is an anti-plugging oscillating shear valve system for generating pressure fluctuations in a flowing drilling fluid. The system includes a stationary stator and an oscillating rotor, both with axial flow passages. The rotor oscillates in close proximity to the stator, at least partially blocking the flow through the stator and generating oscillating pressure pulses. The rotor passes through two zero speed positions during each cycle, facilitating rapid changes in signal phase, frequency, and/or amplitude facilitating enhanced data encoding.

Drilling systems (described below) include mud pumps for conveying drilling fluid into the drillstring and the borehole. Pressure waves from surface mud pumps produce considerable amounts of noise. The pump noise is the result of the motion of the mud pump pistons. The pump noise and other noises interfere with the uplink telemetry signal. Much of the prior art on improving the telemetry system has been directed towards filtering of the received signals to reduce the effects of noise. See, for example, U.S. patent application Ser. No. 11/855,686 (US 20080074948) of Reckmann, U.S. patent application Ser. No. 11/837,213 (US 20080037369) of Hentati, U.S. patent application Ser. No. 11/674,866 (US 20070201308)of Wassermann et al., U.S. Pat. No. 7,577,528 to Li et al., and U.S. patent application Ser. No. 11/675,025 (US 20070132606) of Reckmann et al., all having the same assignee as the present disclosure. U.S. patent application Ser. No. 12/190,430 of Li addresses the problem of increasing the data rate while, at the same time, reducing the error rate in the reconstruction of the telemetered signals. Not addressed in prior art are the problems of borehole imaging of compressed data (where some of the bits of the compressed data are more significant than other bits for image reconstruction), and the problem of different frequency-channels having different quality. The present disclosure addresses this problem.

SUMMARY OF THE DISCLOSURE

One embodiment of the disclosure is a method of communicating a message signal in a wellbore between a downhole location and a surface location. The method includes: acquiring the message signal to be transmitted uphole; encoding the acquired message signal using an encoding scheme in which a first component of the message is protected from errors more than a second component of the message; using a signal generator to generate a modulated signal at the downhole location indicative of the encoded signal; receiving a signal at the surface location responsive to the generated modulated signal; and demodulating and decoding the received signal to provide an estimate of the message signal.

Another embodiment of the disclosure is a system for communicating a message signal in a wellbore between a downhole location and a surface location. The system includes: a sensor configured to acquire data forming the message signal to be transmitted uphole; at least one downhole processor configured to encode the acquired message signal using an encoding scheme in which a first component of the message is protected from errors more than a second component of the message; a signal generator configured to generate a modulated signal at the downhole location indicative of the encoded signal; a receiver at the surface location configured to produce an output responsive to the generated modulated signal; and at least one processor at the surface location configured to demodulate and decode the received signal to provide an estimate of the message signal.

Another embodiment of the disclosure is a computer-readable medium product having stored thereon instructions that when read by at least one processor cause the at least one processor to perform a method. The method includes: encoding a message signal acquired by a downhole sensor in a borehole using an encoding scheme in which a first component of the message is protected from errors more than a second component of the message; causing a signal generator to generate a modulated signal at the downhole location indicative of the encoded signal; and demodulating and decoding a signal received at the uphole location to provide an estimate of the message signal.

BRIEF DESCRIPTION OF THE DRAWINGS

The patent or application file contains at least one drawing executed in color. Copies of this patent or patent application publication with color drawing(s) will be provided by the Office upon request and payment of the necessary fee. For detailed understanding of the present disclosure, references should be made to the following detailed description of one embodiment, taken in conjunction with the accompanying drawings, in which like elements have been given like numerals and wherein.

DETAILED DESCRIPTION OF THE DISCLOSURE

Figure 1:
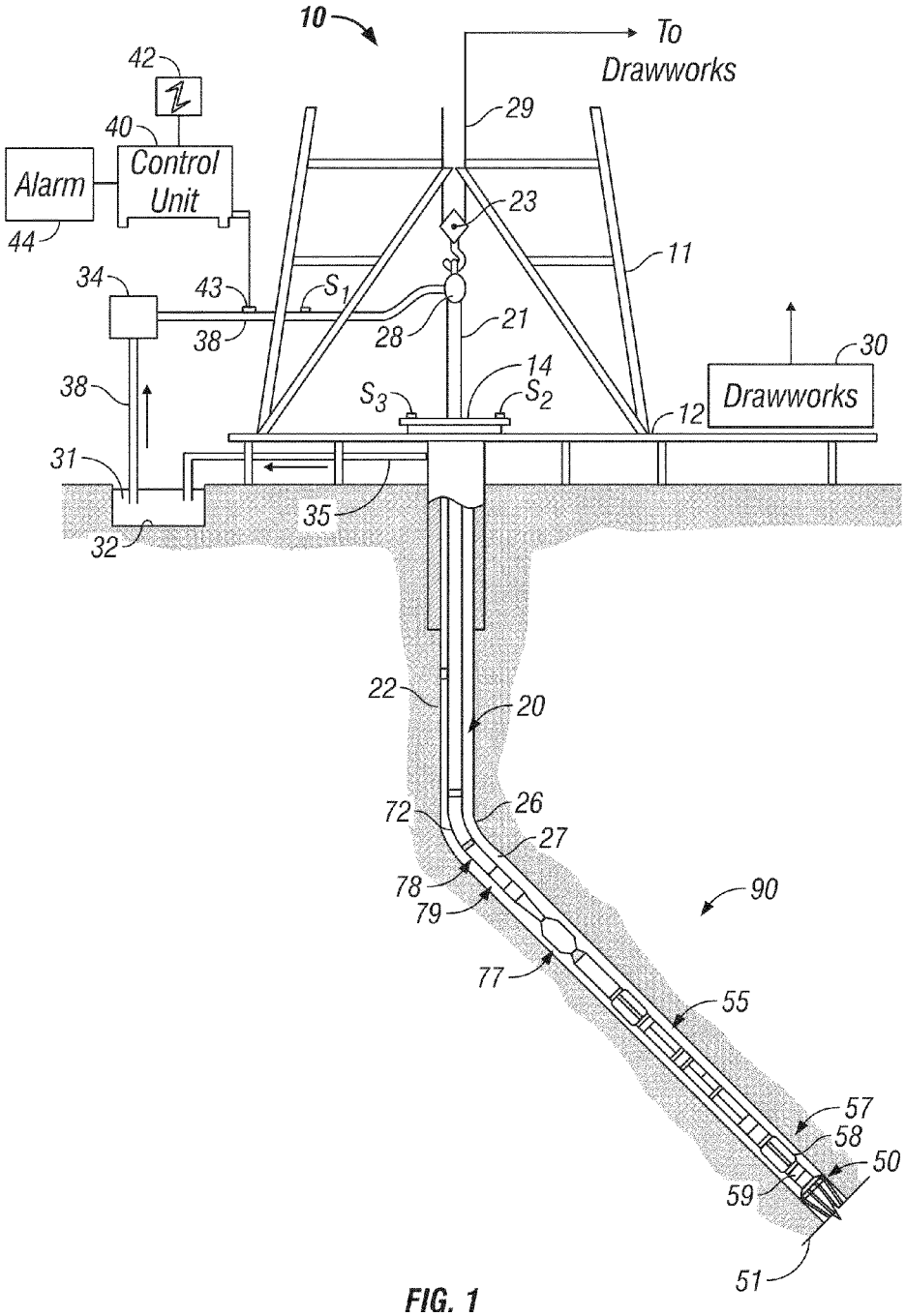
FIG. 1 shows a schematic diagram of a drilling system with a drillstring carrying a drilling assembly conveyed in a borehole for drilling the borehole.

FIG. 1 shows a schematic diagram of a drilling system 10 with a drillstring 20 carrying a drilling assembly 90 (also referred to as the bottomhole assembly, or "BHA") conveyed in a "wellbore" or "borehole" 26 for drilling the borehole. The drilling system 10 includes a conventional derrick 11 erected on a floor 12 which supports a rotary table 14 that is rotated by a prime mover such as an electric motor (not shown) at a desired rotational speed. The drillstring 20 includes a tubing such as a drill pipe 22 or a coiled-tubing extending downward from the surface into the borehole 26. The drillstring 20 is pushed into the borehole 26 when a drill pipe 22 is used as the tubing. For coiled-tubing applications, a tubing injector, such as an injector (not shown), however, is used to move the tubing from a source thereof, such as a reel (not shown), to the borehole 26. The drill bit 50 attached to the end of the drillstring breaks up the geological formations when it is rotated to drill the borehole 26. If a drill pipe 22 is used, the drillstring 20 is coupled to a drawworks 30 via a Kelly joint 21, swivel 28, and line 29 through a pulley 23. During drilling operations, the drawworks 30 is operated to control the weight on bit, which is an important parameter that affects the rate of penetration. The operation of the drawworks is well known in the art and is thus not described in detail herein.

During drilling operations, a suitable drilling fluid 31 from a mud pit (source) 32 is circulated under pressure through a channel in the drillstring 20 by a mud pump 34. The drilling fluid passes from the mud pump 34 into the drillstring 20 via a desurger (not shown), fluid line 38 and Kelly joint 21. The drilling fluid 31 is discharged at the borehole bottom 51 through an opening in the drill bit 50. The drilling fluid 31 circulates uphole through the annular space 27 between the drillstring 20 and the borehole 26 and returns to the mud pit 32 via a return line 35. The drilling fluid acts to lubricate the drill bit 50 and to carry borehole cutting or chips away from the drill bit 50. A sensor $S_1$ typically placed in the line 38 provides information about the fluid flow rate. A surface torque sensor $S_2$ and a sensor $S_3$ associated with the drillstring 20 respectively provide information about the torque and rotational speed of the drillstring. Additionally, a sensor (not shown) associated with line 29 is used to provide the hook load of the drillstring 20.

In one embodiment of the disclosure, the drill bit 50 is rotated by only rotating the drill pipe 22. In another embodiment of the disclosure, a downhole motor 55 (mud motor) is disposed in the drilling assembly 90 to rotate the drill bit 50 and the drill pipe 22 is rotated usually to supplement the rotational power, if required, and to effect changes in the drilling direction.

In an exemplary embodiment of FIG. 1, the mud motor 55 is coupled to the drill bit 50 via a drive shaft (not shown) disposed in a bearing assembly 57. The mud motor rotates the drill bit 50 when the drilling fluid 31 passes through the mud motor 55 under pressure. The bearing assembly 57 supports the radial and axial forces of the drill bit. A stabilizer 58 coupled to the bearing assembly 57 acts as a centralizer for the lowermost portion of the mud motor assembly.

In one embodiment of the disclosure, a drilling sensor module 59 is placed near the drill bit 50. The drilling sensor module contains sensors, circuitry and processing software and algorithms relating to the dynamic drilling parameters. Such parameters typically include bit bounce, stick-slip of the drilling assembly, backward rotation, torque, shocks, borehole and annulus pressure, acceleration measurements and other measurements of the drill bit condition. A suitable telemetry or communication sub 72 using, for example, two-way telemetry, is also provided as illustrated in the drilling assembly 90. The drilling sensor module processes the sensor information and transmits it to the surface control unit 40 via the telemetry system 72.

The communication sub 72, a power unit 78 and an MWD tool 79 are all connected in tandem with the drillstring 20. Flex subs, for example, are used in connecting the MWD tool 79 in the drilling assembly 90. Such subs and tools form the bottom hole drilling assembly 90 between the drillstring 20 and the drill bit 50. The drilling assembly 90 makes various measurements including the pulsed nuclear magnetic resonance measurements while the borehole 26 is being drilled. The communication sub 72 obtains the signals and measurements and transfers the signals, using two-way telemetry, for example, to be processed on the surface. The telemetry method is discussed further below. Alternatively, the signals can be processed using a downhole processor in the drilling assembly 90.

The surface control unit or processor 40 also receives signals from other downhole sensors and devices and signals from sensors $S_1$-$S_3$ and other sensors used in the system 10 and processes such signals according to programmed instructions provided to the surface control unit 40. The surface control unit 40 displays desired drilling parameters and other information on a display/monitor 42 utilized by an operator to control the drilling operations. The surface control unit 40 typically includes a computer or a microprocessor-based processing system, memory for storing programs or models and data, a recorder for recording data, and other peripherals. The control unit 40 is typically adapted to activate alarms 44 when certain unsafe or undesirable operating conditions occur. The system also includes a downhole processor, a sensor assembly for making formation evaluation measurements, and an orientation sensor. These may be located at any suitable position on the bottomhole assembly (BHA). The downhole processor encodes the measurements made by the formation evaluation sensors and by the other sensor that provide measurements of drilling conditions, and encodes the measurements for transmission by the telemetry sub 72.

Figure 2A:
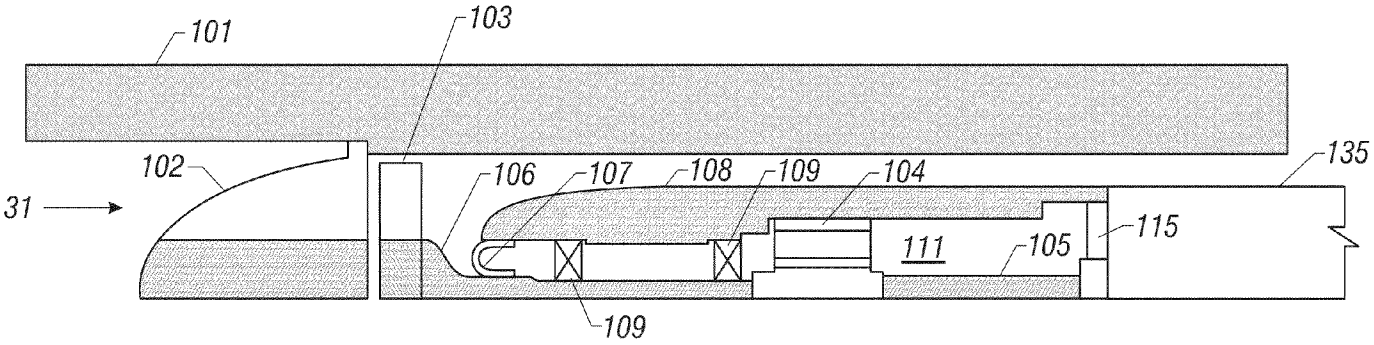
FIG. 2A (Prior Art)
FIG. 2A (prior art) is a schematic view of a pulser assembly for mud pulse telemetry.

FIG. 2A is a schematic view of the pulser, also called an oscillating shear valve, assembly 19, for mud pulse telemetry. The pulser assembly 19 is located in the inner bore of the tool housing 101. The housing 101 may be a bored drill collar in the bottom hole assembly 10, or, alternatively, a separate housing adapted to fit into a drill collar bore. The drilling fluid 31 flows through the stator 102 and rotor 103 and passes through the annulus between the pulser housing 108 and the inner diameter of the tool housing 101.

Figure 2C:
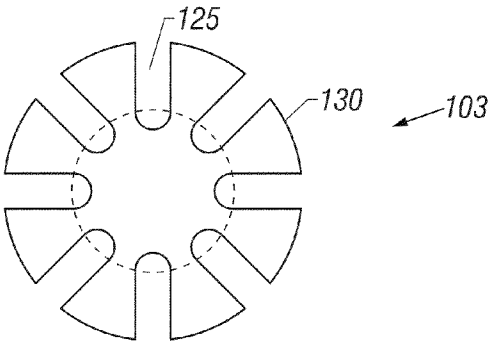
FIG. 2C (Prior Art)
FIG. 2C (prior art) shows a rotor of the pulser assembly of FIG. 2A.
Figure 2B:
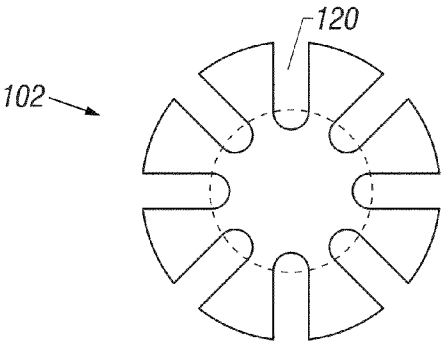
FIG. 2B (Prior Art)
FIG. 2B (prior art) shows a stator of the pulser assembly of FIG. 2A.

The stator 102, see FIGS. 2A and 2B, is fixed with respect to the tool housing 101 and to the pulser housing 108 and has multiple lengthwise flow passages 120. The rotor 103, see FIGS. 2A and 2C, is disk shaped with notched blades 130 creating flow passages 125 similar in size and shape to the flow passages 120 in the stator 102. Alternatively, the flow passages 120 and 125 may be holes through the stator 102 and the rotor 103, respectively. The rotor passages 125 are adapted such that they can be aligned, at one angular position with the stator passages 120 to create a straight through flow path. The rotor 103 is positioned in close proximity to the stator 102 and is adapted to rotationally oscillate. An angular displacement of the rotor 103 with respect to the stator 102 changes the effective flow area creating pressure fluctuations in the circulated mud column. To achieve one pressure cycle it is necessary to open and close the flow channel by changing the angular positioning of the rotor blades 130 with respect to the stator flow passage 120. This can be done with an oscillating movement of the rotor 103. Rotor blades 130 are rotated in a first direction until the flow area is fully or partly restricted. This creates a pressure increase. They are then rotated in the opposite direction to open the flow path again. This creates a pressure decrease. The required angular displacement depends on the design of the rotor 103 and stator 102. The more flow paths the rotor 103 incorporates, the less the angular displacement required to create a pressure fluctuation is. A small actuation angle to create the pressure drop is desirable. The power required to accelerate the rotor 103 is proportional to the angular displacement. The lower the angular displacement is, the lower the required actuation power to accelerate or decelerate the rotor 103 is. As an example, with eight flow openings on the rotor 103 and on the stator 102, an angular displacement of approximately 22.5° is used to create the pressure drop. This keeps the actuation energy relatively small at high pulse frequencies. Note that it is not necessary to completely block the flow to create a pressure pulse and therefore different amounts of blockage, or angular rotation, create different pulse amplitudes.

The rotor 103 is attached to shaft 106. Shaft 106 passes through a flexible bellows 107 and fits through bearings 109 which fix the shaft in radial and axial location with respect to housing 108. The shaft is connected to a electrical motor 104, which may be a reversible brushless DC motor, a servomotor, or a stepper motor. The motor 104 is electronically controlled, by circuitry in the electronics module 135, to allow the rotor 103 to be precisely driven in either direction. The precise control of the rotor 103 position provides for specific shaping of the generated pressure pulse. Such motors are commercially available and are not discussed further. The electronics module 135 may contain a programmable processor which can be preprogrammed to transmit data utilizing any of a number of encoding schemes which include, but are not limited to, Amplitude Shift Keying (ASK), Frequency Shift Keying (FSK), or Phase Shift Keying (PSK) or a combination of these techniques. Specific encoding schemes are discussed below.

In one embodiment of the disclosure, the tool housing 101 has pressure sensors, not shown, mounted in locations above and below the pulser assembly, with the sensing surface exposed to the fluid in the drill string bore. These sensors are powered by the electronics module 135 and can be for receiving surface transmitted pressure pulses. The processor in the electronics module 135 may be programmed to alter the data encoding parameters based on surface transmitted pulses. The encoding parameters can include type of encoding scheme, baseline pulse amplitude, baseline frequency, or other parameters affecting the encoding of data.

The entire pulser housing 108 is filled with appropriate lubricant 111 to lubricate the bearings 109 and to pressure compensate the internal pulser housing 108 pressure with the downhole pressure of the drilling mud 31. The bearings 109 are typical anti-friction bearings known in the art and are not described further. In one embodiment, the seal 107 is a flexible bellows seal directly coupled to the shaft 106 and the pulser housing 108 and hermetically seals the oil filled pulser housing 108. The angular movement of the shaft 106 causes the flexible material of the bellows seal 107 to twist thereby accommodating the angular motion. The flexible bellows material may be an elastomeric material or, alternatively, a fiber reinforced elastomeric material. It is necessary to keep the angular rotation relatively small so that the bellows material will not be overstressed by the twisting motion. In an alternate embodiment, the seal 107 may be an elastomeric rotating shaft seal or a mechanical face seal.

In one embodiment, the motor 104 is adapted with a double ended shaft or alternatively a hollow shaft. One end of the motor shaft is attached to shaft 106 and the other end of the motor shaft is attached to torsion spring 105. The other end of torsion spring 105 is anchored to end cap 115. The torsion spring 105 along with the shaft 106 and the rotor 103 comprise a mechanical spring-mass system. The torsion spring 105 is designed such that this spring-mass system is at its natural frequency at, or near, the desired oscillating pulse frequency of the pulser. The methodology for designing a resonant torsion spring-mass system is well known in the mechanical arts and is not described here. The advantage of a resonant system is that once the system is at resonance, the motor only has to provide power to overcome external forces and system dampening, while the rotational inertia forces are balanced out by the resonating system.

Figure 3:
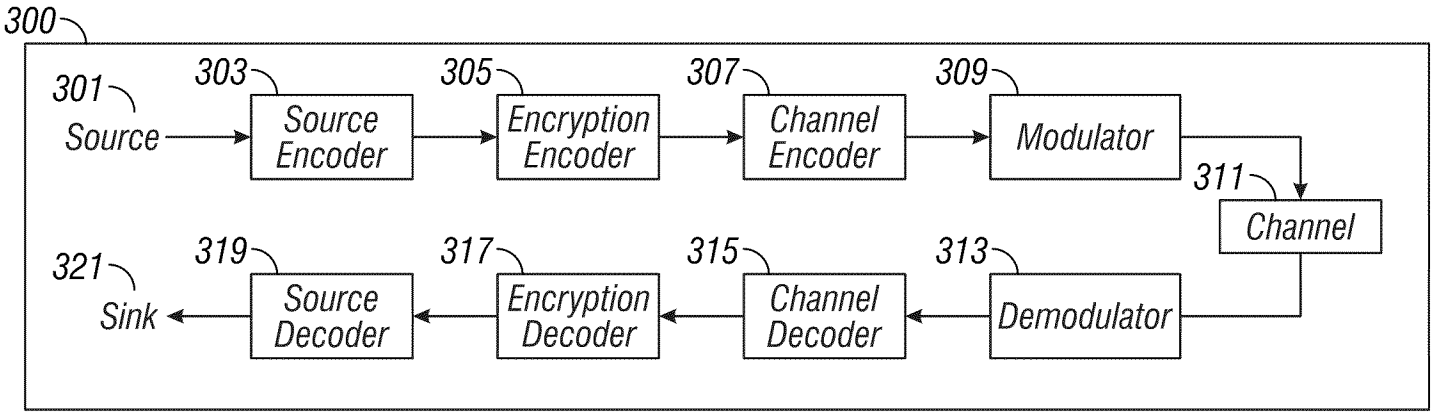
FIG. 3 shows a block diagram for a mud pulse digital communication system.

FIG. 3 shows a block diagram of a mud pulse digital communication system 300. The message signal to be telemetered uphole is indicated by 301. As noted above, this message signal may include formation evaluation measurements and measurements of the state of the drilling system. The source encoder 303 performs data compression by removing the redundancy among source data. The encryption encoder 305 scrambles the information to make unintended listeners unable to discern the information contents. Encryption would not be necessary in a mud pulse telemetry system where access to the communication channel (the fluid in the borehole) is limited. The channel encoder 307 adds redundancy into the information symbols in a controlled way so that the errors introduced during the channel transmission can be detected or corrected. The modulator 309 converts the information symbols into signal waveforms that are suitable for the transmission over the telemetry channel 311. In the present disclosure, the telemetry channel comprises the annulus in the borehole between the drilling tubular and the borehole wall. The components 301, 303, 305, 307 and 309 are all downhole. At the surface, the demodulator 313 coverts the received signal into information symbols. This process typically involves many operations such as synchronization, timing, matched filtering and detection. The channel decoder 315 exploits the intended redundancy to detect or correct any introduced errors. The encryption decoder 317 removes any encryption. The source decoder 319 recovers the compressed source data. The sink 321 is the ultimate destination of the source data. As noted above, for the MPT applications, the encryption encoder and encryption decoder are typically not necessary.

Figure 4A:
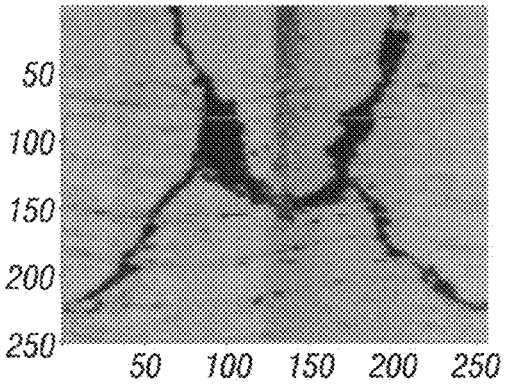
FIG. 4*a* shows an acoustic image.
Figure 4B:
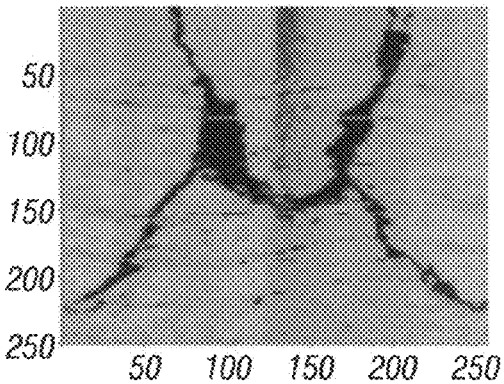
FIG. 4*b* shows a reconstructed image with a compression ratio of 10:1 and a bit error rate of $10^{-4}$ on the least significant bits.
Figure 4C:
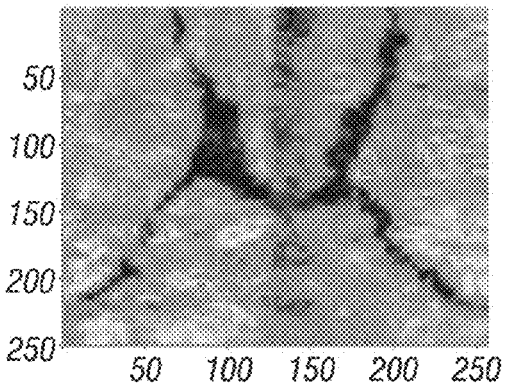
FIG. 4*c* shows a reconstructed image with a compression ratio of 10:1 and a bit error rate of $10^{-4}$ on more significant bits.
Figure 4D:
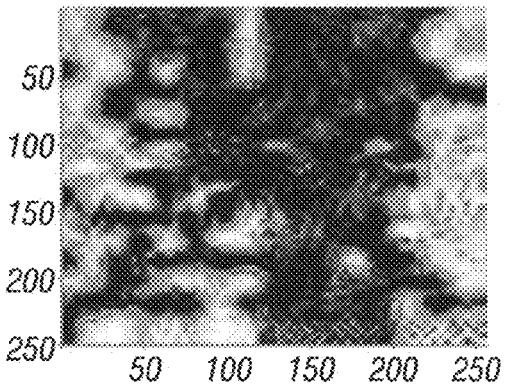
FIG. 4*d* shows a reconstructed image with a compression ratio of 10:1 and a bit error rate of $10^{-4}$ on the most significant bits.

The present disclosure is directed towards the channel encoder 307 and the channel decoder 315 for the problem of protecting borehole imaging data compressed by the method using the discrete wavelet transform (DWT) and progressive set partitioning in hierarchical trees (SPIHT) coding (Li and Wang, 2005). The compressed imaging data by the DWT+SPIHT method have the characteristic of embedded coding that some information bits in the compressed data are more significant for recovering the raw image and thus need more protection than others. FIGS. 4*a*-4*d* shows an example of noise corruption of compressed acoustic images. FIG. 4*a* shows an acoustic image. FIG. 4*b* shows the reconstructed image with a compression ratio of 10:1 and a bit error rate of $10^{-4}$ on the least significant bits. FIG. 4*c* shows the reconstructed image with a compression ratio of 10:1 and a bit error rate of $10^{-4}$ on the more significant bits. FIG. 4*d* shows the reconstructed image with a compression ratio of 10:1 and a bit error rate of $10^{-4}$ on the most significant bits. It can be seen that the loss of significant bits during data transmission or storage could be a disaster for the image recovery.

Adding redundant information bits into the compressed data can help battle errors because the decoder can use this redundant information to detect or correct corrupted information bits. This process is called forward error correction (FEC) coding. There are many ways to do the FEC coding. One may assign the same amount of protection evenly on all information bits. This is the equal error protection (EEP). One may assign a variable amount of protection unevenly according to the significance of the information bits, i.e., more protection for more significant bits and less protection for insignificant bits. This is the unequal error protection (UEP). Compared to the EEP, the UEP on average adds less redundant protection information than does the EEP into the compressed bit stream, and thus sacrifice the compression performance less than the EEP. This UEP scheme is suitable to the compressed imaging data by the DWT+SPIHT method or other similar methods that output embedded coding bit streams where some of the bits are more significant than others for the image recovery. The present disclosure uses UEP.

The UEP scheme is also useful for protecting data stream, not necessarily a compressed data steam, transmitted over variable-quality transmission channels. The term "transmission channel" is defined as one of a plurality of frequency sub-bands that span the available bandwidth of the telemetry channel (the mud in the annulus). As an example, with an available bandwidth of 40 Hz, two transmission channels may be used, one from 0-20 Hz and the other from 20-40Hz. In one embodiment of the disclosure, the UEP is assigned according to the channel quality rather than bit significance. That is, for better transmission channel quality, less protection is assigned. As the transmission channel quality becomes worse, more protection can be assigned. For both embodiments, i.e., embedded coding borehole images and variable-quality transmission channels, on average the UEP adds less redundant information than the EEP, and thus saves the bandwidth of transmission channels. For the purposes of the present disclosure, it can be considered that more protection is assigned to a first component of the message than to a second component of the message. The first component includes the more significant bits or it may include the messages transmitted over a noisy channel.

There are two important classes of FEC codes: linear block codes and convolutional codes. Examples for the former include the well-known Hamming code, Bose, Ray-Chaudhuri and Hocquenghem (BCH) code, and Reed-Solomon (RS) code. The present disclosure with implements a UEP method that uses a hybrid linear block and convolutional code for borehole imaging data compressed by the embedded coding method. The method uses a concatenated code consisting of an outer error detection code—cyclic redundancy check (CRC) code and as an inner FEC code, a rate-compatible punctured convolutional (RCPC) code (Sherwood and Zeger, 1997; Hagenauer,1988). The use of CRC code, other than RS code, as the outer code, has the advantages of extremely low computational complexity and great flexibility in choosing the length of data block. The use of RCPC code has the advantage of providing the UEP without using separate codes. The decoding of the RCPC code uses the list Viterbi algorithm (LVA) (Seshadri and Sundberg, 1994), with the constraint that the decoding also needs to satisfy the parity check of the CRC code. The concatenated RCPC-CRC code has the capabilities of both error detection and error correction. Moreover, it is suitable to downhole applications in that the majority of the computation stemming from the decoding process is conducted on the surface, where more computational power is available. The encoding process requires only a small amount of computation and thus can be conveniently implemented downhole.

A RCPC-CRC code is formed by first performing the CRC encoding on raw information bits and then performing the RCPC encoding on the CRC-encoded information bits. The CRC code is a linear block code. It is used as an error detection code, namely, capable of indicating whether or not error bits have occurred, but neither telling where the errors are, nor correcting them. The RCPC code is a linear convolutional code. It is used as a FEC code, namely, capable of correcting certain error bits by exploiting the added redundancy. The CRC code is simply a cyclic code, and thus is conveniently generated by using a linear feedback shift register (LFSR) (Moon, 2005). In one embodiment of the disclosure, an optimum CRC code with M=16 parity bits suggested by Castagnoli et al. (1990) is used. This code has $H \geq 5$ for the code length $n \leq 257$, where H is defined as the minimum Hamming distance, indicating the smallest number of channel errors that can lead to decoding errors. The error detection capability for a linear block code is thus defined as, $e=H-1$. That is, this 16-bit CRC code is able to detect at least 4 error bits for the code length $n \leq 257$. Note that for given H there is a great flexibility in choosing the length of data block. In one embodiment of the disclosure, this 16-bit CRC code is used.

A convolutional code is generated by passing information bits through a linear finite-state shift register (FSSR) (Proakis, 2001). At a given instant, k-bit information is input to the registers and n-bit convolutional codes are output. The coding rate is thus defined as, R=k/n. The redundancy introduced by the coding is 1-R. The FFSR has the memory capability. For memory length m, the total number of possible register states is 2m. The convolutional code can fully represented by a state diagram, which displays the state transitions between any two states given any input. Another representation of the convolutional code is the tree-structure diagram, called trellis. A rate 1/3 and a rate 1/4 convolutional code with the largest possible minimum free distance D for memory length m=6 were suggested by Larsen (1973). Note that the correction capability of the convolutional code is directly proportional to D, which is directly proportional to m. These two codes are optimal in the sense that for a given m, they have the largest possible D. These two codes are used as the bases to generate the RCPC codes in this disclosure.

A convolutional code with high coding rate is generated by selectively deleting some coded bits resulting from a convolutional code with low coding rate 1/n. The code rate is defined as the portion of the total amount of information that is useful. The process of selectively deleting some coded bits is called puncturing, and the resulted code is called the punctured convolution code. The high-rate punctured convolution code has the advantage of maintaining the same low decoding complexity as the low-rate 1/n code. The disadvantage is that the D of the low-rate 1/n code is reduced and thus the correction capability is degraded by certain amount, depending on the degree of puncturing. Moreover, the correction capability of the high-rate punctured convolution code may not be as good as the same rate convolutional code with the largest possible D. The puncturing process is generally implemented by periodically deleting selected bits from the convolutional encoder outputs. That is, given a rate 1/n parent code and a puncturing period p, the encoder outputs np coded bits in each period. Among them, to determine which coded bits to be deleted, we define the n by p puncturing matrix, where each column corresponds to the n possible output bits for each input bit. The element of the puncturing matrix takes the value of either 0, indicating the corresponding output bit is deleted, or 1, indicating the corresponding output bit is kept. The code rate is thus determined by both the period p and the number of output bits deleted. That is, given q bits among np output bits are deleted, the code rate is $kp/(np-q)$, where k=1 and q may take any integer value from 0 to $(n-1)p-1$. Thus, the code rate of the punctured convolutional code is defined as, $R(p)=p/(p+z)$, where $z=1, 2, \ldots, (n-1)p$.

To implement the UEP for either embedded coding of compressed images or data transmitted over variable-quality channels, it is desirable to use a single code with variable redundancy, rather than multiple codes. To meet this goal, one embodiment of the disclosure uses an RCPC code suggested by Hagenauer (1988), where the puncturing matrix is designed to satisfy a rate-compatibility criterion, which basically requires that lower-rate codes (for higher redundancy) should keep the same output bits as all higher-rate code, plus some additional output bits. In the present disclosure, one of two sets of RCPC codes are used, the two codes being derived from Larsen's rates 1/3 and 1/4 convolutional codes with the largest possible minimum free distance for the memory length m=6. The corresponding puncturing matrices with the period p=8 were suggested by Hagenauer (1988).

To use the RCPC codes for the UEP, it is typical to divide input information bits into several blocks. The length of the blocks does not have to be the same. Given the information of the bit significance or the channel quality, different blocks can be assigned with variable-rate RCPC codes. By doing this, enough error protection can be provided by introducing as little redundancy as possible, which is helpful to save the limited bandwidth of the transmission channels.

The decoding of the concatenated RCPC-CRC code is first performed on the inner code, RCPC code, and then on the outer code, CRC code. The decoding of the RCPC code uses the LVA, with the constraint that the decoding also needs to satisfy the parity check of the CRC code. The decoding of the CRC code is simple. Since the systematic CRC code has been used, the information bit can be directly extracted from the code when the parity check of the CRC code shows no error bit occurs. The decoding of the CRC code can be implemented using the same LFSR for encoding. The input to the LFSR is now the received CRC-coded information bits, possibly corrupted by the channel noise. The output parity bits of the LFSR, s(j), for $j=1, 2, \ldots, M$, is called the syndrome, which is used for the error detection: (1) if $s(j)=0$ for all j, then no error occurred; and (2) if $s(j)\neq 0$ for some of j, then errors occurred. In the first case, the raw information bits can be directly extracted from the received CRC-coded information bits. In the second case, it is said that the CRC code fails the parity check and a decoding failure is claimed.

The Viterbi algorithm (Viterbi, 1967) is the optimum decoder of the convolutional code in the sense of maximum likelihood sequence estimation. The basic idea behind the Viterbi algorithm is to search through the trellis to find a path that has a minimum distance to the received sequence. The metric of the minimum distance is defined as the likelihood function of the transmission channel. For an additive white Gaussian noise (AWGN) channel, the likelihood function is the Euclidean distance. For a binary symmetric channel (BSC), the likelihood function is the Hamming distance (Moon, 2005). To find the minimum distance path is equivalent to find the maximum likelihood estimation of the received sequence. The Viterbi algorithm provides an efficient recursive method to complete such a trellis search, though the computation burden is still heavy.

The decoding of the RCPC codes can be conducted in the same way as the decoding of the low-rate 1/n parent convolutional code, using the same trellis of the 1/n parent code. The only difference is that the metric computations and comparisons exclude the contributions from the paths corresponding to the punctured bits. In this disclosure, the Hamming distance is used as the metric in the trellis search of the Viterbi algorithm, which implies the use of BSC model and the hard-decision decoding. That is, it is assumed that the decoding is applied on the output bits from the demodulator, where operations such as synchronization, timing, matched filtering and detection, have been performed. The LVA provides a rank-ordered list of the L globally candidates of minimum-distance paths after the trellis search of the Viterbi algorithm. Note that the correct decoding of the convolutional code may not always result from the best candidate. In some cases, the lower-rank candidate from the LVA list produces the correct decoding. Thus, by considering the lower-rank candidates in addition to the best one, we may obtain a significant improvement in the decoding performance. In this disclosure, the parity check of the CRC code is used as the criterion to determine which candidate from the LVA list produces the correct RCPC decoding. If all L candidates fail the parity check, it is said that the RCPC decoding is failure. Obviously, larger L means more computation. It has been proven that the correct RCPC decoding results from the top 10 candidates in over 98% cases (Sherwood and Zeger, 1997). Thus, we choose L=10 for the LVA in this disclosure.

The performance of the RCPC-CRC code has been experimentally evaluated through investigating three codes for three bit error rates (BER). Case 1 has a rate 2/7 code for BER=$10^{-}$ 1; case 2 has a rate 2/3 code for BER=$10^{-2}$; and case 3 has a rate 4/5 code for BER=$10^{-3}$. Two sets of testing data are studied. One is for simulated data where 12800 binary bits are generated from a uniformly distributed random number generator and form one group of the testing data. A total of 100 independent groups of such data are generated.

The second set of testing data are from the acoustic image shown in FIG. 4. The image size is 256 by 256 samples. The dynamic range of the sample values is from 0 to 4095, which means that each sample value is represented by 12 binary bits. Thus, the total number of the binary bits representing this image is 786432. These binary information bits are first encoded with the RCPC-CRC code, and then some of the coded bits are flipped to simulate the noise corrupted error bits. The number of bits to be flipped is determined by the BER values. The locations of the flipped bits are random, with a uniform distribution, to simulate random channel noise. The binary bit stream is divided into blocks and the RCPC-CRC coding applies on each block separately. The block length is set to be 128 bits for this testing. The decoded binary bits are compared to the original bits for calculating the BER. An average value of the BER from all blocks and all groups of testing data is used to measure the performance of the RCPC-CRC code.

Figure 5:
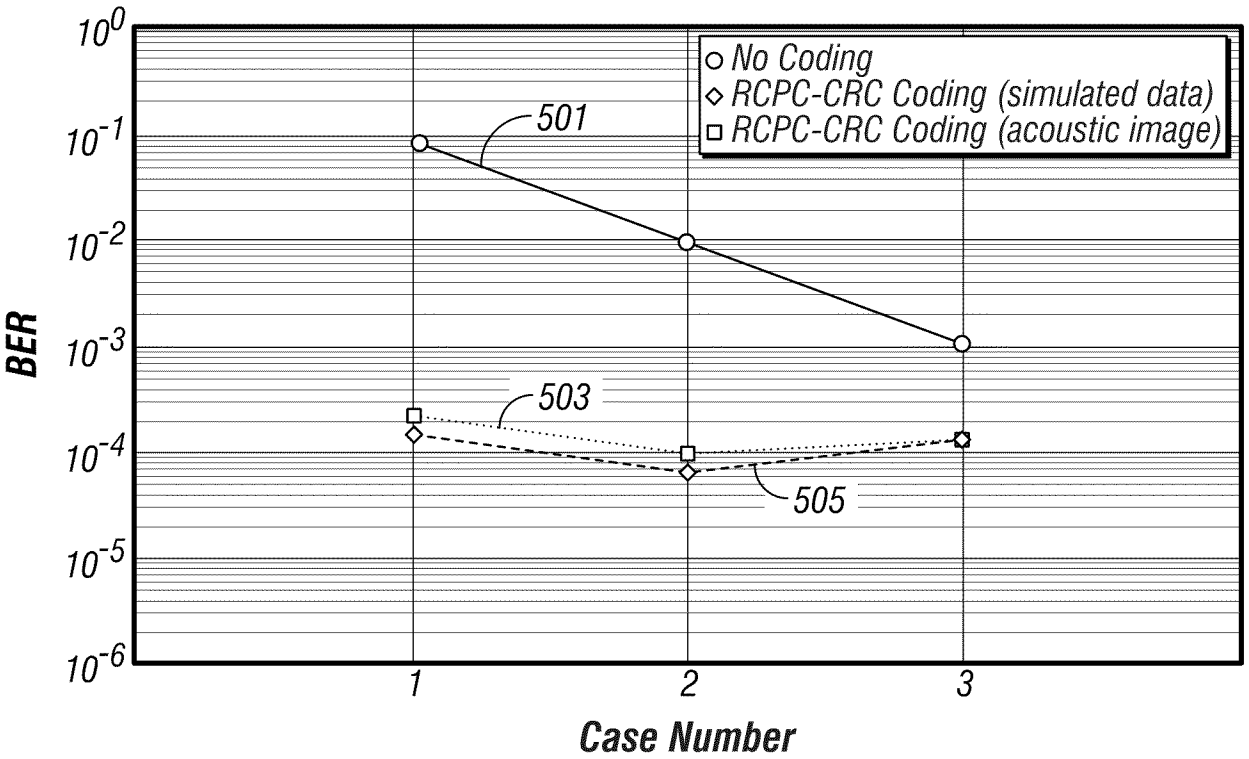
FIG. 5 shows the results of using an encoding-decoding scheme of the present disclosure.
Figure 6:
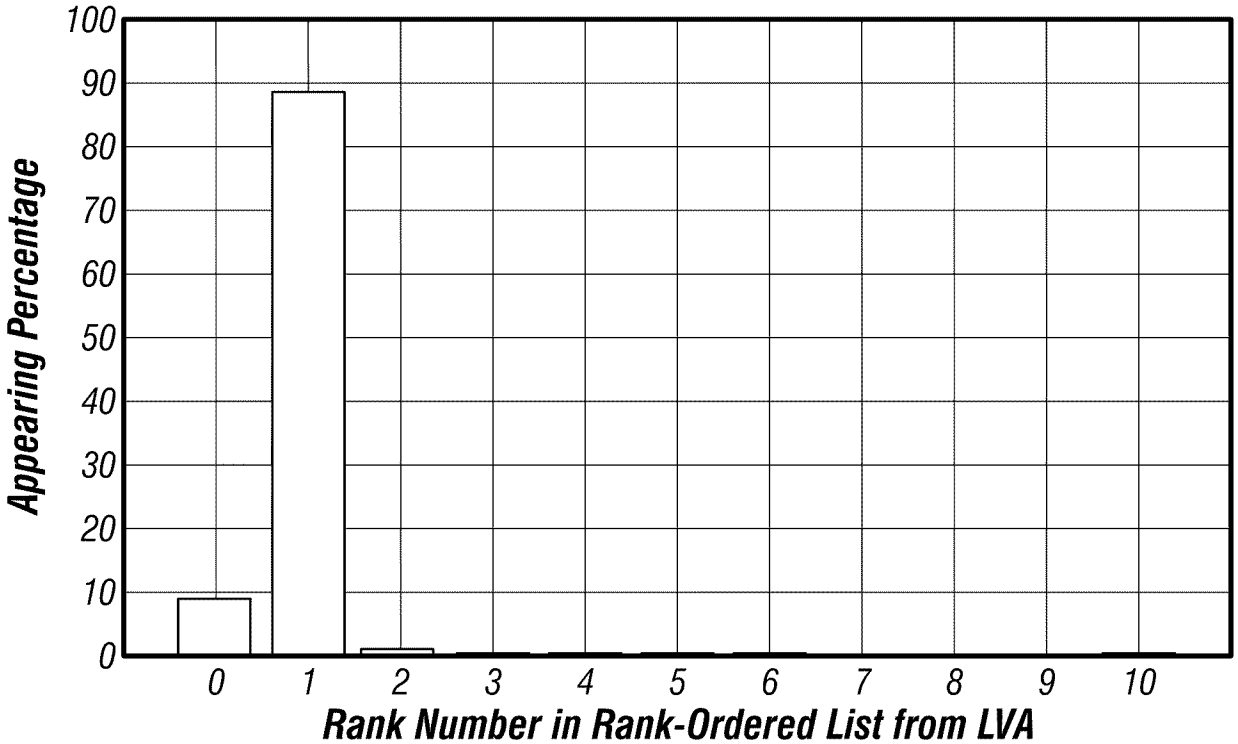
FIG. 6 shows statistics on the success of the decoding method.

FIG. 5 shows the BER results for the three experimental cases. The abscissa is the case number discussed above. The ordinate is the bit error rate in the decoded message. The curve 501 corresponds to no coding, so that the bit error rate for the decoded message is the same as the BER for the transmitted message. 503 shows the results for the RCPC-CRC coding for the simulated data while 505 shows the results for the RCPC-CRC coding for the simulated data. In general, the RCPC-CRC code performs very well. All three investigated codes are able to reduce the BER from $10^{-1}$, $10^{-2}$ and $10^{-3}$, to around $10^{-4}$, respectively. Note that the BER results from the simulated data and the acoustic imaging data are consistent.

FIG. 5 shows statistics on the success or failure of the RCPC decoding measured by the parity check of the CRC code in the LVA. The statistics are compiled using the experiment results from case 1 with the acoustic imaging data. The rank number 0 indicates the failure of the RCPC decoding. Other numbers, corresponding to respective ranks in the rank-ordered list from the LVA, indicate the success of the decoding. Note that while a majority of correct RCPC decoding stems from the rank number 1, corresponding to the best candidate from the trellis search, some of the correct decoding do result from the lower-rank candidates.

The disclosure of unequal error protection for embedded block coding has been with respect to the MPT system, but this is not to be construed as a limitation. The methodology is also suitable for electromagnetic telemetry and wired pipe telemetry.

The operation of the transmitter and receivers may be controlled by the downhole processor and/or the surface processor. The modulation/encoding and demodulation/decoding are done by the downhole processor and the surface processor respectively. Implicit in the control and processing of the data is the use of a computer program on a suitable machine readable medium that enables the processor to perform the control and processing. The machine readable medium may include ROMs, EPROMs, EAROMs, Flash Memories and Optical disks. The results of the processing include telemetry signal estimates relating to measurements made by downhole formation evaluation sensors. Such results are commonly stored on a suitable medium and may be used for further actions in reservoir development such as the completion of wells and the drilling of additional wells.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure.

What is claimed is:

1. A method of communicating a message signal in a wellbore between a downhole location and a surface location, the method comprising:

acquiring the message signal to be transmitted to the surface location at at least one downhole processor;

using the at least one downhole processor to encode the acquired message signal using an encoding scheme in which a first component of the message is protected from errors more than a second component of the message;

using a signal generator to generate a modulated signal at the downhole location indicative of the encoded signal;

using a receiver to receive a signal at the surface location responsive to the generated modulated signal; and using the at least one surface processor to demodulate and decode the received signal to provide an estimate of the message signal.

2. The method of claim 1 wherein the message signal further comprises an image indicative of an image of an earth formation and wherein the first component further comprises bits having higher significance than a significance of bits of the second component.

3. The method of claim 2 further comprising using the at least one processor to compress the message signal prior to the encoding.

4. The method of claim 3 further comprising using the at least one processor to compress the message signal using a set partitioning of hierarchical trees.

5. The method of claim 1 wherein the first component further comprises a portion of the message signal configured to be communicated over a data channel having a lower quality than a data channel over which the second component is configured to be communicated.

6. The method of claim 1 further comprising obtaining the message signal by at least one of: (i) making a measurement of a formation property using by a formation evaluation sensor, and (ii) using a sensor to make a measurement of a drilling condition.

7. The method of claim 1 further comprising using an encoding scheme that includes a hybrid linear block code and a convolutional code.

8. The method of claim 7 further comprising using a puncturing matrix as part of the encoding scheme.

9. A system for communicating a message signal in a wellbore between a downhole location and a surface location, the system comprising:

a sensor configured to acquire data forming the message signal to be transmitted uphole;

at least one downhole processor configured to encode the acquired message signal using an encoding scheme in which a first component of the message is protected from errors more than a second component of the message;

a signal generator configured to generate a modulated signal at the downhole location indicative of the encoded signal;

a receiver at the surface location configured to produce an output responsive to the generated modulated signal; and at least one processor at the surface location configured to demodulate and decode the received signal to provide an estimate of the message signal.

10. The system of claim 9 wherein the message signal further comprises an image indicative of an image of an earth formation and wherein the first component further comprises bits having higher significance than a significance of bits of the second component.

11. The system of claim 10 wherein the at least one processor is further configured to compress the message signal prior to the encoding.

12. The system of claim 11 wherein the at least one processor is further configured to compress the message signal using a set partitioning of hierarchical trees.

13. The system of claim 9 wherein the first component further comprises a portion of the message signal configured to be communicated over a data channel having a lower quality than a data channel over which the second component is configured to be communicated.

14. The system of claim 9 further a sensor configured to provide the message signal by at least one of: (i) making a measurement of a formation property, and (ii) making a measurement of a drilling condition.

15. The system of claim 9 wherein the at least one processor is further configured to use an encoding scheme that includes a hybrid linear block code and a convolutional code.

16. The system of claim 15 wherein the at least one processor is further configured to use a puncturing matrix as part of the encoding scheme.

17. The system of claim 11 wherein the sensor is disposed on a bottomhole assembly configured to be conveyed in the borehole on a drilling tubular.

18. A non-transitory computer-readable medium product having stored thereon instructions that when read by at least one processor cause the at least one processor to perform a method, the method comprising:

encoding a message signal acquired by a downhole sensor in a borehole using an encoding scheme in which a first component of the message is protected from errors more than a second component of the message;

causing a signal generator to generate a modulated signal at the downhole location indicative of the encoded signal; and demodulating and decoding a signal received at the uphole location to provide an estimate of the message signal.

19. The non-transitory computer-readable medium product of claim 18 further comprising at least one of: (i) a ROM, (ii) an EPROM, (iii) an EAROM, (iv) a flash memory, and (v) an optical disk.

* * * * *